United States Patent [19]

Glucksman

[11] 4,328,818

[45] May 11, 1982

[54] HAND HELD HAIR DRYER

[76] Inventor: Dov Z. Glucksman, 175 Freeman St., Brookline, Mass. 02146

[21] Appl. No.: 680,697

[22] Filed: Apr. 27, 1976

[51] Int. Cl.[3] ..... A45D 20/00

[52] U.S. Cl. ..... 132/9; 219/370

[58] Field of Search ..... 132/9, 11, 112; 34/97, 34/90, 101; 219/222, 370–374, 39, 375

[56] References Cited

U.S. PATENT DOCUMENTS

| | | | |
|---|---|---|---|
| 2,678,376 | 5/1954 | Lockwood | 219/370 |
| 2,817,000 | 12/1957 | Scheid | 219/39 |
| 3,599,345 | 8/1971 | Tolmie | 132/9 |
| 3,610,881 | 10/1971 | Stewart | 219/374 |
| 3,837,581 | 9/1974 | Orsoff | 34/97 |
| 3,981,314 | 9/1976 | Barradas | 34/97 |
| 4,039,774 | 8/1977 | Kata | 219/375 |

*Primary Examiner*—G. E. McNeill

*Attorney, Agent, or Firm*—John S. Roberts, Jr.

[57] ABSTRACT

A domestic hair dryer comprises an axisymetrical casing of circular cross section, the rear part of which forms a tubular grip, housing an electric switch and cable connection. The front part of the casing is enlarged in the form of an ellipsoid or prolate spheroid with its front end cut off to form an air outlet. This front end also contains a connector for attaching a hollow hair brush. The spherical front part contains an electric motor with an axial fan impeller mounted on its shaft positioned so as to rotate in its widest portion. In front of the impeller a heating element is fastened inside the casing, which element is in the shape of a hollow cylindrical cage formed by air guide vanes; these are alternately connected at their opposite ends to form an electric circuit in zigzag shape. The cage is of an inner diameter similar to that of the air outlet and is fastened at its front end adjacent this outlet. The air delivered by the fan passes between the vanes through the cage from the outside to the inside, and leaves the dryer through the air outlet after having been heated during its passage through the element.

4 Claims, 4 Drawing Figures

HAND HELD HAIR DRYER

BACKGROUND OF THE INVENTION

The invention relates to an apparatus for emitting a jet of hot air, more especially to a hair dryer for domestic use having a cylindrical brush attached to its air outlet.

Most hair dryers for domestic use require a centrifugal blower in order to overcome the air resistance of the electric resistor in the shape of a wire coil as well as that of the brush attached to the air outlet. Since the air outlet of a centrifugal blower is at right angles to the blower axis this type of hair dryer is usually designed and built in pistol-shape:- the casing comprises a barrel which contains the electric resistor, a cylindrical blower housing to the rear of the barrel, and a grip attached to the blower housing, usually at right angles to the barrel axis. This grip also contains a switch and the electric connections and cable.

With a view to streamlining the casing and to make it lighter and handier, I have invented a hair dryer having a tubular heating element and a low-resistance brush, which is the subject of my co-pending patent application Ser. No. 662,807 filed Mar. 1, 1976 now U.S. Pat. No. 4,090,061 dated May 16, 1978. Herein the air resistance of both the heating element and the brush are low enough to permit the use of an axial fan with attached guide vanes and, accordingly, of a straight axisymmetrical casing.

It has been experienced that the tubular heating element of the said hairdryer added unnecessarily to the length of the unit, while the placement of the guide vanes necessitated an increase in the casing diameter. It is, therefore, the object of the present invention to still decrease the length and the diameter of the hair dryer by incorporating the guide vanes in the heating element proper.

In my co-pending patent application Ser. No. 662,807, filed Mar. 1, 1976, now U.S. Pat. No. 4,090,061 dated May 16, 1978. I have described and claimed an electric air heating unit comprising a centrifugal blower with its impeller peripherally enclosed by a stationary cylindrical cage of guide vanes which also serve as electric resistors for heating the passage of air through them. The heating element according to said patent application is in the shape of a hollow cylindrical cage of longitudinal guide vanes with their leading edges in parallel, each vane forming a flat or curved, ribbon-shaped resistor; these resistor vanes are arranged to form one or several circuits adapted to be electrically energised for heating the air delivered by the impeller. In addition, they are angularly positioned to guide the air flow in a predetermined direction.

SUMMARY OF THE INVENTION

Incorporating this type of heating element, the hair dryer, according to the invention, comprises in combination, an axisymetrical casing provided with a co-axial outlet at its front end, and with a tubular grip forming its rear portion, the front portion of the casing having a larger cross section than both the grip portion and the air outlet, gradually decreasing from a largest diameter towards the front outlet opening, while the portion to the rear of the largest diameter is perforated by air inlet openings, preferably distributed over the entire circumference, an axial fan impeller of a diameter commensurate with the largest cross section of the casing, positioned inside the casing in front of the said air inlet openings, which impeller is directly attached to the shaft of an electric motor which latter is rigidly and and co-axially fixed in the said casing, a heating element in the shape of a hollow cage of parallel, angularly positioned guide vanes which are adapted to be electrically energised and heated, the cage being of a diameter smaller than the impeller and of an inner diameter substantially equal to the air outlet, the cage being positioned in the casing between the air outlet and the fan impeller, while its front end is fastened to the casing wall proximate to the air outlet, being connected to electric connecting and switching means for energizing the motor and/or the heating element.

The fan sucks the air into the casing through the air inlets and drives it through the cage from the outside to the inside, whereby the air is heated on its passage through the vanes and emitted through the air outlet in front of the cage.

In a preferred embodiment of the invention the casing is provided, adjacent to the air outlet with means for attaching a hollow hair brush, the latter being provided with lateral openings from escape of the heated air through bristles attached to its outside.

The front portion of the casing is preferably in the shape of a prolate spheroid with its front portion cut off to form the said air outlet and with its rear portion gradually merging with the tubular grip portion.

In a preferred embodiment of the invention the rear end of the cage-shaped heating element is supported in a spider-shaped body which is positioned inside the central portion of the spheroid, the arms of the spider being in the shape of flat radial vanes with their planes passing through the casing axis.

BRIEF DESCRIPTION OF THE DRAWINGS

In the accompanying drawing which illustrates, by way of example only, one embodiment of the invention.

Figure 1:
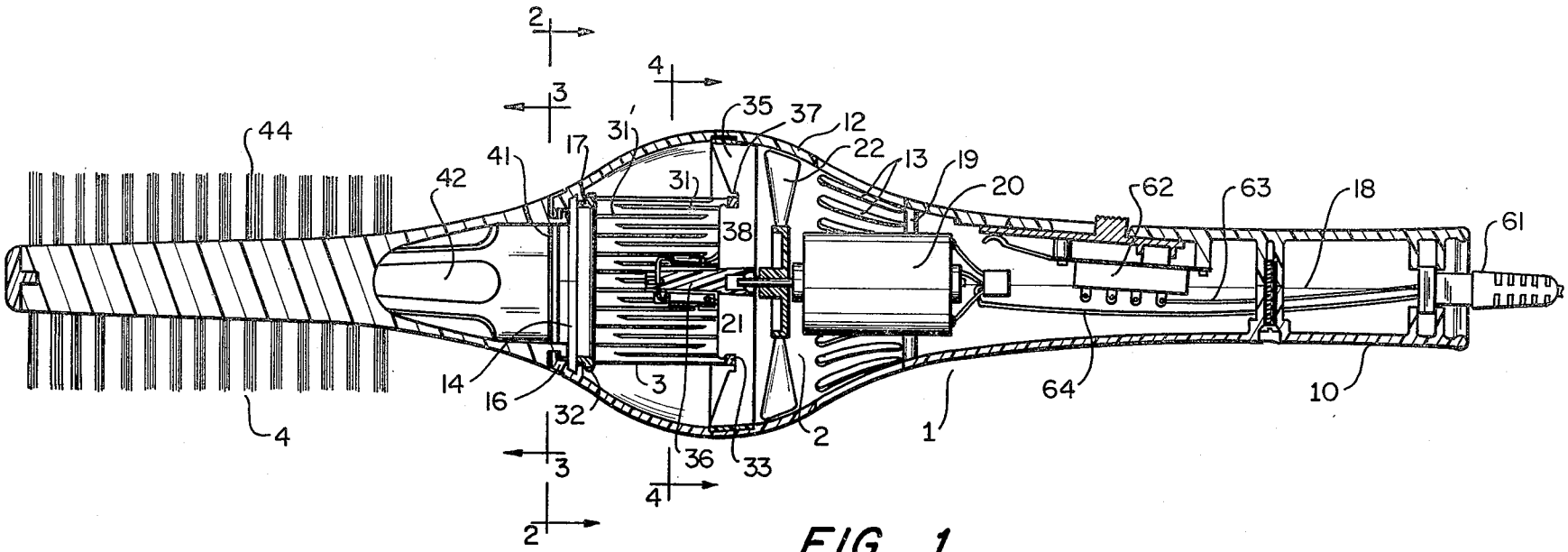
FIG. 1 is a longitudinal section through a hairdryer with a brush attached.
Figure 4:
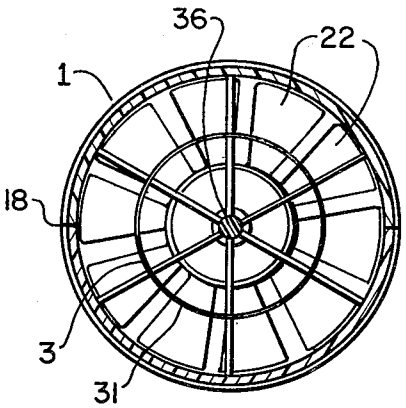
FIG. 4 is a section along 4—4 of FIG. 1.
Figure 3:
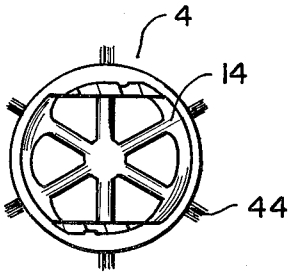
FIG. 3 is a section along 3—3 of FIG. 1.
Figure 2:
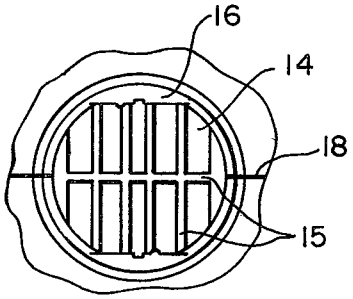
FIG. 2 is a section along 2—2 of FIG. 1.

The hair dryer illustrated in the drawing mainly comprises a casing 1, a fan unit 2 and a heating element, complete with supports, 3. A detachable brush 4 shown fastened to the front of the casing, but it is understood that the hairdryer may be equally used without this attachment. Starting from the rear, the casing comprises a tubular handle 10 provided with a cable connection 61 and a switch assembly 62. The front portion 12 of the casing is of larger dimension that the grip and has the form of an ellipsoid or a prolate spheroid. The rear portion of the spheroid is perforated by air inlet slots 13 which are evenly distributed over the entire circumference, while the front portion is cut off perpendicular to the casing axis to form an air outlet 14. This air outlet is covered by a protective grille 15 and is provided with detent projections 16 adapted to engage and hold the brush 4 in a suitable recesses 41. The casing is assembled from two halves in a manner known to the art, the split line 18 being visible in the FIGS. 1, 2 and 4. The heating element 3 is in the form of a cage of thin metal sheeting, the edges of which are alternately slotted (31, 31') to form a continuous zigzag-shaped circuit of resistor vanes which are alternately connected at their opposite ends which also define the two ends of the cage proper.

Various embodiments of this type of resistor have been described in my co-pending application Ser. No. 662,807 filed Mar. 1, 1976, now U.S. Pat. No. 4,090,061 dated May 16, 1978 and any of these embodiments may be usefully mounted in the present hairdryer. The depicted heating cage is provided with a front rim 32 and a rear rim 33, the front rim engaging with an internal annular projection 17 at the front of the casing, while the rear rim is positioned and held in a spider which latter comprises a hub 36 from which six radial vanes extend as far as the casing inside where they are held by clamping. The vanes 35 run parallel to the casing axis and serve as guide vanes for straightening the air flow emerging from the fan impeller; they are provided with slots 37 serving to receive and hold the rear rim 33 of the cage.

The rear end of the hub 36 is hollowed out and contains a cup bearing 38 serving to support and guide the motor shaft 21.

The fan unit comprises an electric motor 20, rigidly held in the casing by prongs projecting inwardly from the casing wall. An axial fan impeller 22 is mounted on the motor shaft 21 which latter is extended beyond the impeller and supported in the said bearing cup 38.

Electric wires 63 and 64 of the cable 61 are shown to connect the switch assembly 62 and the motor 20 respectively, but for the sake of clarity connecting wires between the switch assembly, the motor and the heating element respectively have been omitted in the drawing. The heating element 3 is in the form of a cage of thin metal sheeting, the edges of which are alternately slotted (31, 31') to form a continuous zigzag-shaped circuit of resistor vanes which are alternately connected at their opposite ends which also define the two ends of the cage proper. Various embodiments of this type of resistor have been described in my co-pending patent application No. 662,807, and any of these embodiments may be usefully mounted in the present hairdryer. The depicted heating cage is provided with a front rim 32. A thermostat and a fuse 65 are connected to the hub 36 of the spider, extending into the center of the cage and serve to prevent overheating.

The air sucked into the casing by the fan impeller, through the inlet openings 13, leaves the impeller in both axial and rotary motion; passing through the vanes 35 of the spider the air flow is more or less straightened into axial direction, before it enters the resistor cage from the outside. The curvature of the casing is designed so as to guide the air into the vanes in substantially uniform distribution, with a view to obtain a maximum heating effect with a minimum of air resistance. The air leaves the casing through the outlet 14 and enters the brush interior from which it is expelled through slots 42 into the bristles 44.

The main advantage of the present invention is that the air passes through the casing in a substantially straight path without bends. Another important advantage is that the short heating element and the axial fan permit the casing to be designed in a very compact manner that obviously results in a lightweight appliance.

Only one embodiment of the hairdryer, according to the invention, is illustrated and described in this description, however the apparatus may be modified and its configuration changed in accordance with requirements or changes in fashion.

The main, front portion may be spherical instead of ellipsoidal. The portion connecting the front portion with the grip may be in the shape of a truncated cone or of a flat disc perpendicular to the casing axis, with the inlet openings perforating the cone or the disc in any desired shape.

The spider as well as the front shaft bearing (38) may be omitted altogether: the air leaving the fan in spiral or circular motion can be straightened by choosing a predetermined incident angle of the resistor vanes. The bearing 38 is not necessary whenever the motor is rigidly and steadily positioned in the casing.

I claim:

1. A domestic hair dryer of the type adapted to have a hair brush attached thereto comprising in combination a casing of circular transverse cross-section having a tubular handle portion at its rear end and an enlarged front portion, said front portion being of bulbous configuration and having its wall gradually increasing in diameter from the handle portion to a central portion of maximum diameter and then gradually decreasing in diameter to a terminal end portion constituting an air outlet, said wall having air inlet openings therein distributed about the circumference thereof immediately in advance of the handle portion; a motor driven fan of the axial flow propellor type supported within the casing, the diameter of said fan being commensurate with the diameter of the casing immediately rearwards of the wall portion of largest diameter; a heating element in the shape of a hollow cylindrical cage of parallel angularly positioned guide vanes, said guide vanes being adapted to be electrically energized and heated, said cage having an outer diameter less than that of said fan and an inner diameter substantially equal to the inner diameter of said air outlet; supporting means for said cage positioning the same within said casing between said fan and said air outlet, said supporting means including means directly connecting one end of said cage to said casing wall adjacent said air outlet; and electrical connections and switching means for selectively energizing one or both of said motor driven fan and said heating element, whereby air drawn into said casing is directed by said fan to be guided by said casing wall to flow into and through said cage from the outer side thereof and to leave said outlet in unimpeded flow from the interior of said cage.

2. The domestic hair dryer according to claim 1 in which said supporting means includes a spider means positioned inside the central portion of said front portion of said casing and extending thereacross, said spider means having arms in the shape of flat radial vanes, the planes of which pass through the axis of said casing and means connecting the other end of said cage to said spider means.

3. The domestic hair dryer according to claim 2 in which said motor driven fan includes a shaft carrying said fan and having a portion extending forwardly thereof and said spider means including a hub portion having a bearing therein for journaling said portion of said shaft.

4. The domestic hair dryer according to claim 3 wherein said hub of said spider means includes a portion extending into said cage and thermostat means fastened to said portion of said hub means that extend into said cage.

* * * * *